United States Patent [19]

Wey et al.

[11] Patent Number: 4,657,194

[45] Date of Patent: Apr. 14, 1987

[54] AUTOMATIC BOBBIN WINDER WITH A TRAVELLING BOBBIN CHANGER

[75] Inventors: Edmund Wey, Nettetal; Gregor Kathke, Viersen; Manfred Langen, Monchen-Gladbach, all of Fed. Rep. of Germany

[73] Assignee: W. Schlafhorst & Co., Monchen-Gladbach, Fed. Rep. of Germany

[21] Appl. No.: 844,815

[22] Filed: Mar. 27, 1986

[30] Foreign Application Priority Data

Mar. 30, 1985 [DE] Fed. Rep. of Germany ..... 3511815

[51] Int. Cl.[4] ..... B65H 67/04; B65H 67/06

[52] U.S. Cl. ..... 242/35.5 A; 198/420

[58] Field of Search ..... 242/35.5 A, 35.5 R, 242/35.6 R, 18 R; 198/420, 347, 468.8

[56] References Cited

U.S. PATENT DOCUMENTS

| | | | |
|---|---|---|---|
| 3,987,974 | 10/1976 | Mayer | 242/35.5 A |
| 4,153,211 | 5/1979 | Lenk et al. | 242/35.5 A |
| 4,340,187 | 7/1982 | Schippers et al. | 242/35.5 A |
| 4,427,158 | 1/1984 | Conrad | 242/35.5 A |
| 4,541,577 | 9/1985 | Suzuki et al. | 242/35.5 A |
| 4,541,578 | 9/1985 | Kawarabashi et al. | 242/35.5 A |
| 4,555,067 | 11/1985 | Angelucci et al. | 242/35.5 A |
| 4,565,278 | 1/1986 | Asai et al. | 242/35.5 A X |
| 4,582,270 | 4/1986 | Asai et al. | 242/35.5 A |
| 4,591,106 | 5/1986 | Gay | 242/35.5 A X |

*Primary Examiner*—Stanley N. Gilreath

*Attorney, Agent, or Firm*—Herbert L. Lerner; Laurence A. Greenberg

[57] ABSTRACT

An automatic bobbin winder includes a bobbin removal location; a bobbin transfer point; a bobbin conveyor belt for storing bobbins and transporting bobbins toward the bobbin removal location, the bobbin conveyor belt having an end at the bobbin transfer point; a travelling bobbin changer disposed below the bobbin conveyor belt for transporting individual bobbins; a bobbin transfer device at the bobbin transfer point being controlled by the bobbin changer for successively transferring bobbins from the bobbin changer to the bobbin conveyor belt; a device for advancing the bobbin conveyor belt by at least one bobbin width in a given storage direction prior to each bobbin transfer; and a device for initiating a priority transport run of the bobbin changer for transporting an individual bobbin to the transfer point after each bobbin transfer.

11 Claims, 2 Drawing Figures

AUTOMATIC BOBBIN WINDER WITH A TRAVELLING BOBBIN CHANGER

Figure 1:
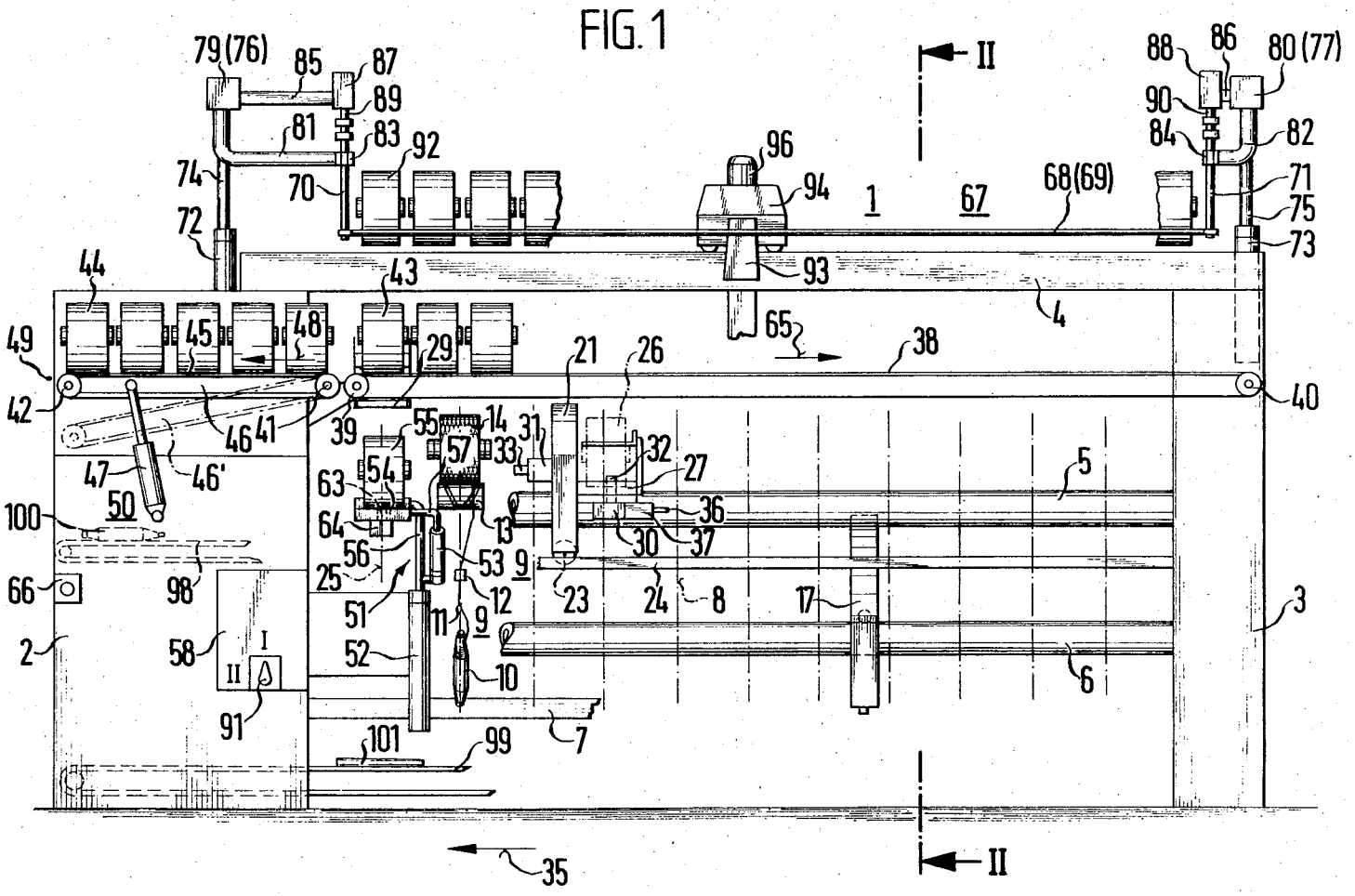

The invention relates to an automatic bobbin winder with a travelling bobbin changer and a bobbin conveyor belt which can be loaded by the bobbin changer, which serves for storing bobbins and which leads to a bobbin removal location.

The bobbin changer in such a device can place a bobbin on the bobbin conveyor belt only if the conveyor belt is standing still. In addition, the bobbin changer can deposit a bobbin only if an empty space exists at a respective location on the bobbin conveyor belt. Since this cannot always be assured, the bobbin changer must wait until the bobbin conveyor belt is cleared.

Ordinarily, the changer does not operate as long as the bobbin conveyor belt is being cleared and it deposits bobbins on the cleared bobbin conveyor belt until it determines that a bobbin already lies on the conveyor belt at a winding station at which a bobbin change must again be carried out. A signal to clear the bobbin conveyor belt can then be given by the bobbin changer. However, it is only in very rare cases that the bobbin conveyor belt is loaded with bobbins without a gap at this point in time. The storage capacity of the bobbin conveyor belt is therefore different from case to case and the bobbin conveyor belt cannot be utilized fully as a bobbin storage device which would make sense economically.

It is accordingly an object of the invention to provide an automatic bobbin winder with a travelling bobbin changer, which overcomes the hereinafore-mentioned disadvantages of the heretofore-known devices of this general type, and to assure an economically logical interaction of the bobbin changer, bobbin storage device and bobbin removal.

With the foregoing and other objects in view there is provided, in accordance with the invention, an automatic bobbin winder, comprising a bobbin removal location; a bobbin transfer point; a bobbin conveyor belt for storing bobbins and transporting bobbins toward the bobbin removal location, the bobbin conveyor belt having an end at the bobbin transfer point; a travelling bobbin changer disposed below the bobbin conveyor belt for transporting individual bobbins; a bobbin transfer device at the bobbin transfer point being controlled by the bobbin changer for successively transferring bobbins from the bobbin changer to the bobbin conveyor belt; means for advancing the bobbin conveyor belt by at least one bobbin width in a given storage direction prior to each bobbin transfer; and means disposed on the winder and/or on the bobbin changer for initiating a priority transport run of the bobbin changer for transporting an individual bobbin to the transfer point after each bobbin transfer.

During every bobbin transfer to the bobbin conveyor belt, the bobbin conveyor belt travels on by a distance equal to the width of a bobbin or slightly less, so that the maximum theoretical storage capacity of the bobbin conveyor belt can be fully utilized.

In accordance with another feature of the invention, the bobbin transfer point is disposed in the vicinity of the bobbin removal location, the bobbin conveyor belt runs in a given forward direction toward the bobbin removal location and in a given reverse direction which is the storage direction, the bobbin transfer device switches the bobbin conveyor belt to the reverse direction for a limited time prior to each bobbin transfer, and including means for switching the bobbin conveyor belt to the forward direction with a bobbin removal device or manually.

In any case, the bobbin is transferred to the bobbin conveyor belt and not to a device which already belongs to the bobbin removal location. In the process, the bobbin conveyor belt is filled with bobbins from the front toward the rear. If the bobbin change returns from the transfer point to a winding station in order to carry out a bobbin change there, the bobbin conveyor belt can be switched to "forward" by a bobbin removal device or by hand and thereby can be emptied entirely or partially.

In certain cases it is desirable to always maintain a very definite number of bobbins in reserve, which can then be removed as a bobbin packet. Therefore, in accordance with a further feature of the invention, there is provided another flat bobbin conveyor disposed adjacent the first-mentioned bobbin conveyor belt downstream of the bobbin transfer point in bobbin transport direction toward the bobbin removal location for storing bobbins and transporting bobbins to the bobbin removal location. Such a flat conveyor is preferably an inclined roller track or a conveyor belt.

In accordance with an added feature of the invention, there are included means for adjusting the inclination of the other flat bobbin conveyor. This is done so that the end point of the conveyor can be adapted to the height of a loading and transporting device above the floor level, which may vary.

In accordance with an additional feature of the invention, the bobbin transfer device is part of the bobbin changer.

In accordance with again another feature of the invention, there is provided a machine frame, the bobbin transfer device being fixed to the machine frame at an end of the bobbin conveyor belt.

In accordance with again a further feature of the invention, the bobbin transfer device includes a dish for transporting one bobbin each time and means for tilting the dish up and down. Such a dish can remain in the tilted-up condition as long as it does not have to transport the bobbin. This is advantageous in the case of automatic bobbin winders which are close together and therefore have operating isles which are not narrowed by bulky transfer devices.

In accordance with again an added feature of the invention, the priority transport run initiating means includes a priority circuit favoring the bobbin transfer device over bobbin removal. In the case of manual removal, such a priority circuit is not absolutely necessary because in this case an operator can see when the bobbin changer is working and the bobbin conveyor belt can be cleared during this time.

In accordance with a concomitant feature of the invention, there is provided a switchable bobbin gripping and lifting device disposed above the bobbin conveyor belt for storing bobbins in addition to the bobbin conveyor belt.

In the most favorable case, such a device can provide a storage extension of 100%. For instance, the bobbin gripping and lifting device can have horizontal rods disposed along the bobbin conveyor belt which, in the best case, can grip all bobbins lying on the bobbin conveyor belt and lift them subsequently. The bobbin conveyor belt can then be loaded again.

The storage extension has the advantage of providing an interval between the individual clearing operations which is substantially larger than without storage extensions.

Other features which are considered as characteristic for the invention are set forth in the appended claims.

Although the invention is illustrated and described herein as embodied in an automatic bobbin winder with a travelling bobbin changer, it is nevertheless not intended to be limited to the details shown, since various modifications and structural changes may be made therein without departing from the spirit of the invention and within the scope and range of equivalents of the claims.

Figure 2:
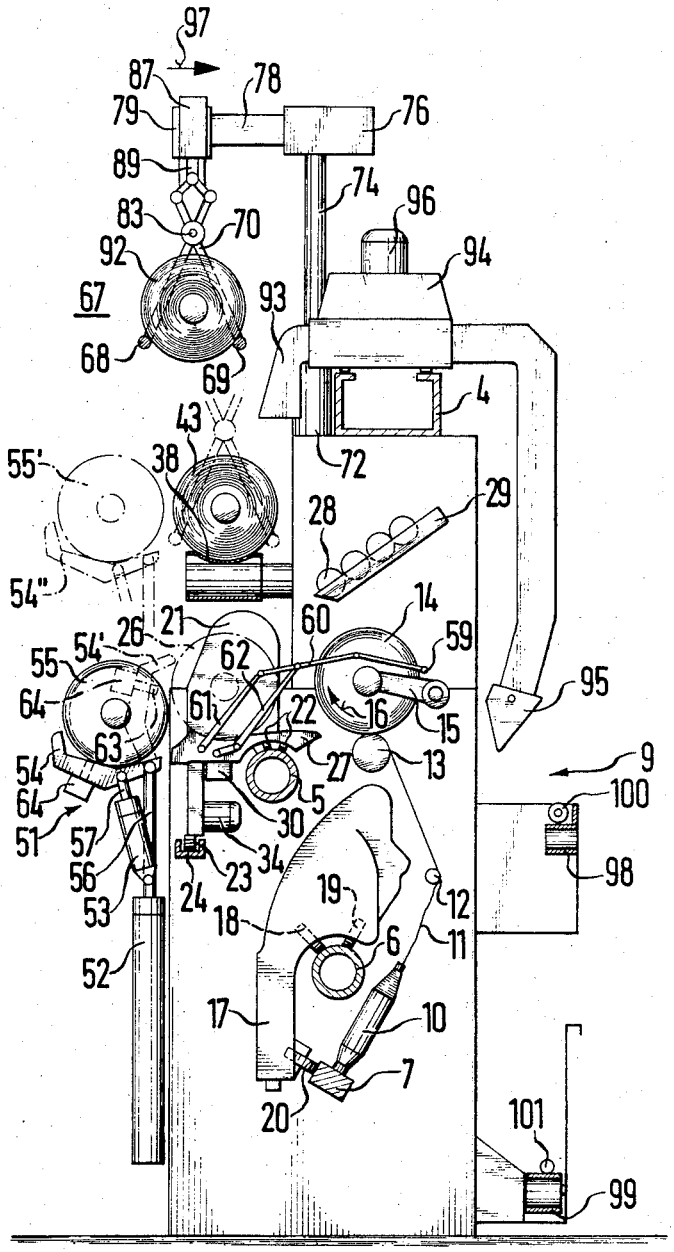

The construction and method of operation of the invention, however, together with additional objects and advantages thereof will be best understood from the following description of specific embodiments when read in connection with the accompanying drawings, in which:

FIG. 1 is a fragmentary, diagrammatic, elevational view of an automatic bobbin winder according to the invention; and FIG. 2 is a cross-sectional view of the automatic bobbin winder taken along the line II—II of FIG. 1, in the direction of the arrows.

Referring now in detail to FIGS. 1 and 2 of the drawings as a whole, it is seen that an automatic winder which is designated as a whole with reference numeral 1 has two end frames 2, 3 that are connected to each other by cross pieces or traverses 4 to 7. In particular, individual winding stations, which total 10, are fastened to the cross pieces 5, 6 and 7.

In FIG. 1, center lines indicate the location of individual winding stations 8. The figures only show details of the first winding station which is generally designated with reference numeral 9. A creel or run off bobbin 10 supported by the cross piece 7 furnishes a thread 11 which runs through a thread tensioner 12 and arrives at a cross-wound bobbin or cheese 14 by way of a winding cylinder or roller 13 provided with reverse-winding grooves. The cross-wound bobbin 14 is rotatably supported at a pivotable winding or bobbin frame 15, it rests on the winding cylinder 13 and is driven by the winding cylinder in the direction of an arrow 16 by means of friction.

A travelling thread-joining device 17 is provided with rollers 18, 19 and a support roll 20. The thread-joining device is supported by the rollers 18, 19 on the cross piece 6 and it is supported against the cross piece 7 by the support roll 20. The thread-joining device has a propulsion motor of its own which enables it to travel to a winding station at which a thread break is to be corrected.

A travelling bobbin changer 21 has rollers 22, 23, by means of which it can travel along the cross piece 5, while being guided by a rail 24 past the winding stations to a transfer point designated as a whole with reference numeral 25. In FIG. 1, the transfer point 25 is indicated by a center line. As soon as the bobbin changer 21 is located at the transfer point 25, the bobbin center of the bobbin 26 transported by the bobbin changer 21 coincides with the center line of the transfer point 25.

The bobbin changer 21 has to fulfill several functions. At the winding stations, the bobbin changer exchanges the completely wound bobbins, such as the bobbin 14 and initially deposits this bobbin on a loading surface 27. The bobbin changer 21 may also have a non-illustrated device for taking an empty tube 28 from a tube magazine 29 and inserting it into the bobbin frame 15 after the bobbin 14 is exchanged. Such devices are conventional in bobbin changers. However, the bobbin changer 21 simultaneously serves as an individual coil transporter inasmuch as it transports each bobbin which it has taken to the transfer point 25 and delivers it there.

In order for the bobbin changer 21 to fulfill its function well as an individual bobbin transporter, it has means for carrying out a high-priority transport run after each bobbin changing process, in order to transport the individual bobbin to the transfer point 25. The high-priority transport means first includes a microswitch 30 and second a microswitch 31. A plunger 32 of the microswitch 30 protrudes upward from the loading surface 27, so that the microswitch 30 can be closed as soon as a bobbin 26 rests against the plunger 32. The microswitch 30 switches the propulsion motor 34 of the bobbin changer 21 to "forward" so that the bobbin changer 21 moves in the direction of the arrow 35 until the plunger 33 of the second microswitch 31 hits the wall of the end frame 2, which causes the propulsion motor 34 to be switched off.

The loaded bobbin is then lifted, as will be explained below, and as soon as this occurs the first microswitch 30 switches again and thereby releases the bobbin changer 21 for a new bobbin changing operation. This is done in the simplest way by switching the propulsion motor back to "reverse" so that the bobbin changer 21 is set in motion in the direction toward the end frame 3. Along the way, the bobbin changer can be stopped by a winding station which needs a bobbin change.

If no bobbin change is necessary during the first run, the travel direction of the bobbin changer 21 is reversed if a plunger 36 of a further microswitch 37 runs against the wall of the end frame 3 and thereby switches the propulsion motor 34 back to "forward" for motion in the direction of the arrow 35. If no bobbin change takes place during this run as well, the plunger 33 of the microswitch subsequently runs against the wall of the end frame 2, so that the direction of travel of the propulsion motor 34 is reversed again. During reciprocating travel, the bobbin changer 21 travels back and forth in this manner until it is finally stopped by a winding station requiring a bobbin change. According to the state of the art, this is accomplished by running against a plunger which can be extended by the winding station in question. As soon as a new bobbin then arrives on the loading surface 27, the above-described operations start over again.

Naturally, in an alternate construction the microswitch 31 could be attached to the end frame 2 and thereby to the automatic bobbin winder 1 itself. A wire connection to the propulsion motor 34 from the stationary microswitch would then be required.

A bobbin conveyor belt 38 which serves for bobbin storage, is disposed above the bobbin changer 21. The bobbin conveyor belt 38 runs over a driven belt roller 39 and another belt roller 40. The bobbin conveyor belt 38 already contains three bobbins, the first of which is designated with reference numeral 43.

The bobbin conveyor belt 38 is followed downstream of the transfer point 25 by a flat conveyor 45 which serves for additional bobbin storage and is likewise constructed as a conveyor belt. The conveyor belt 45 runs over a driven belt roller 41 and another belt roller 42. The belt roller 42 is supported at a rib or bar 46 which can be tilted about the axis of rotation of the belt roller 41 by means of a pneumatic lifting device 47, such as downward to a position 46'. The travel direction 48 of the flat conveyor 45 is from the bobbin coveyor belt 38 to a bobbin removal point 49 of a bobbin removal location designated overall with reference numeral 50.

A transfer device 51 which cooperates with the bobbin changer 21 and the bobbin conveyor belt 38 can be controlled by the bobbin changer 21. The transfer device 51 has a pneumatic lifting device 52 which has a dish or tray 54 for receiving a bobbin 55. The dish 54 is articulatingly disposed at the end of a piston rod 56 of the lifting device 52. A further pneumatic lifting device 53 is flexibly fastened to the same piston rod 56. The further pneumatic lifting device 53 has a piston rod 57 which is also flexibly connected with the dish 54. The second lifting device 53 serves to swing the dish 54 from the position shown in solid lines in FIG. 2 up to the position 54' shown in phantom. In this lifted position, the transfer device 51 awaits the arrival of the bobbin changer 21.

The two pneumatic lifting devices 52 and 53 have non-illustrated functional connections to a central control device 58.

The transfer device 51 at the transferring point 25 can be controlled by the bobbin changer 21 in the following manner:

In the rest position, the lifting device 52 is inactive and the piston rod 57 of the lifting device 53 is moved out so that the dish 54 is in the position 54'. The bobbin changer 21 takes a fully wound bobbin 14 according to FIG. 2 by means of a fetching arm 59. The fetching arm 59 is located at the end of a rod 60 which is linked to levers 61, 62 that can move synchronously on circular tracks. As soon as the levers 61, 62 are synchronously swung counterclockwise by the bobbin changer 21, the fetching arm 59 takes the bobbin 14 along and initially only lets it slide up to the rolling surface 27 by operating the microswitch 30. The bobbin changer 21 is then set in motion toward the transfer point 25. Upon arrival at the point 25, the switching microswitch 31 not only activates the shutdown of the propulsion motor 34 but it also causes the two levers 61 and 62 to swing further counterclockwise, so that the loaded bobbin, in this case the bobbin 26, is pushed against the vertical dish 54 and against a plunger 63 of a microswitch 64. The dish 54 gives way and is swung against the pneumatic resistance of the lifting device 53 into the horizontal position with the bobbin 55, as is shown in FIG. 2. In the process, the plunger 63 is depressed by the bobbin 55 so that the microswitch 64 switches. The microswitch 64 has a non-illustrated functional connection to the control device 58 which starts a program timer. The program timer successively initiates the following activities:

Initially, the lifting device 52 is acted upon so that the dish 54 moves to a position 54" according to FIG. 2 and the bobbin 55 resting thereon moves into the position 55'. In this way, the bobbin 55 is already located above the upper edge of the bobbin conveyor belt 38. Subsequently, the control device 58 activates the lifting device 53, so that the piston rod 57 of the device is run out. As a result, the dish 54 moves from the position 54", so that the bobbin 55 is rolled onto the bobbin conveyor belt 38 simply by swinging up the dish 54.

According to FIG. 1 the space on the bobbin conveyor belt 38 which is to be occupied by the bobbin 55 that is to be transported up, is already occupied by a bobbin 43. In order to make room for the bobbin 55 on the conveyor belt 38, simultaneously with addressing the lifting device 52, the control device 58 causes the switching of the belt roller 39 to "reverse" and specifically only until the bobbin conveyor belt 38 has travelled along in the storage direction 65, symbolized by an arrow, through a distance that is somewhat more than a bobbin width.

Before the bobbin 55 which is to be deposited on the bobbin conveyor belt 38 reaches the belt, room has been made for it on the bobbin conveyor belt at the transfer point 25. After the bobbin is transferred to the bobbin conveyor belt, the piston rod 57 of the lifting device 53 remains extended and only the piston rod 56 of the lifting device 52 is returned to the starting position. Then, the activity of the control device 58 for this bobbin transfer operation is finished. In the meantime, the bobbin changer 21 has been released after the plunger 32 was relieved of its load by the microswitch 30, for a new bobbin changing process or for a search trip. While the transfer device 51 is still busy with the bobbin transfer, the bobbin changer 21 can therefore become active again.

In order to clear the stored bobbins, a switch 66 which can be manually operated is provided at the end frame 2. As soon as a bobbin receiving device, such as a non-illustrated carriage, is brought up to the end face of the end frame 2, the switch 66 can be closed. The switch 66 is functionally connected to the control device 58, where a further functional connection to the two driven belt rollers 41 and 39 is established through a non-illustrated priority circuit. The above-mentioned priority circuit favors the transfer device 51, so that the bobbin transfer has priority over the bobbin removal. After the response of the microswitch 64, the priority circuit causes the switch 66 to become inoperative and causes belt roller drives which are already running to be optionally shut off. As soon as the transfer device 51 has terminated its activity, the priority circuit releases the switch 66 again. The priority circuit may be formed of a relay which can be switched by the microswitch 64 and which is connected into the drive circuit of the driven belt rollers 39 and 41.

The switch 66 can optionally be switched on and off automatically, by a non-illustrated travelling bobbin removal device.

Since the two conveyor belts 38 and 45 start up simultaneously after the switch 66 is closed, the bobbins on the flat conveyor 45 are successively given to a bobbin removal device located at the bobbin removal point 49, while the bobbins located on the bobbin conveyor belt 38 successively travel to the flat conveyor 45.

Disposed above the bobbin conveyor belt 38 is a switchable bobbin gripping and lifting device 67 which serves as a storage extension of the bobbin conveyor belt. The device 67 is substantially formed of two horizontal rods 68 and 69 which are capable of gripping both sides of all of the bobbins located on the conveyor belt 38 from below, at a location above the conveyor belt 38, and of lifting up the entire row of bobbins so that the bobbin conveyor belt 38 becomes free for receiving a further row of bobbins.

In the illustrated embodiment, the two rods 68 and 69 end at two scissors 70 and 71, respectively.

The scissors 70 and 71 can be actuated and moved up and down in the following manner:

The end frame 2 carries a pneumatic lifting device 72 and the end frame 3 carries a pneumatic lifting device 73. A piston rod 74 of the pneumatic lifting device 72 carries a further lifting device 76 which is horizontal. A piston rod 75 of the lifting device 73 similarly carries a horizontal lifting device 77. An end of a piston rod 78 of the lifting device 76 carries a head 79 and an end of a piston rod of the corresponding other lifting device 77 carries a head 80. Fastened to the head 79 is a cross piece 81, at which a fulcrum 83 of the scissors 70 is supported. Fastened to the head 80 is a cross piece 82 at which a fulcrum 84 of the scissors 71 is supported. A further cross piece 85 which likewise carries a lifting device 87, is fastened at the head 79. A piston rod 89 of a lifting device 87 is flexibly linked to the scissors 70 so that these scissors can be opened to a greater or lesser extent. A piston rod 90 of a lifting device 88 is flexibly connected to the scissors 71 so that the scissors 71 can be opened to a greater or lesser extent.

The bobbin gripping and lifting device 67 is controlled by the control device 58 which receives the control command from a manually operated switch 91. The switch 91 has two positions. According to FIG. 1, the switch 91 is in the position I. This position means "store". FIG. 1 shows that the bobbin gripping and lifting device 64 has stored a bobbin 92 and other similar bobbins.

If the switch 91 is then set to position II meaning "bobbin delivery", the following occurs:

The control device 58 allows a timing mechanism to run, which successively acts through non-illustrated functional connections on the pneumatic gripping and lifting device 67 in order to carry out the following activities: first, the two lifting devices 72 and 73 are relieved of load, in order to lower the two rods 68 and 69 along with the bobbin 92 and the other stored bobbins, until they are below a blasting nozzle 93 which belongs to a travelling blasting device 94. The blasting device 94 has a propulsion mechanism, by means of which it can travel back and forth on the cross piece 4. The blasting device 94 also has a second blasting nozzle 95 on the other machine side, and is equipped with a blower motor 96.

As soon as the bobbins stored by the bobbin gripping and lifting device 67 are located below the blasting nozzle 93, the lifting devices 76 and 77 are relieved of load so that the heads 79 and 80 are moved a small distance in the direction of an arrow 97 in FIG. 2. In the meantime, the lifting devices 72 and 73 continue to be relieved of load until finally, the stored bobbins rest on the bobbin conveyor belt 38 and the two rods 68 and 69 lose contact with the bobbins. The two lifting devices 87 and 88 are subsequently acted upon so that both scissors 70 and 71 open. With the scissors open, the two lifting devices 72 and 73 are subsequently acted upon again, so that the heads 79 and 80 finally reassume the same height or level as before in the storage position. However, the two heads 79 and 80 seen in FIG. 2, are offset by a small distance in the direction of the arrow 97.

For instance, if the bobbin conveyor belt 38 is subsequently filled with bobbins again or if it at least has a certain degree of fullness with bobbins, the switch 91 can be put in position I "store". As soon as this has happened, the following occurs:

First, the two lifting devices 72 and 73 are completely relieved of load so that the two rods 68 and 69 approximately reach the height of the upper section or run of the bobbin conveyor belt 38. Thereupon, the two lifting devices 87 and 88 are relieved of load, so that the two piston rods 89 and 90 are lifted by means of non-illustrated storing springs, with the result that the two scissors 70 and 71 close. Subsequently, the two lifting devices 72 and 73 are acted upon again and while the two scissors 70 and 71 lift up the row of bobbins, the two lifting devices 76 and 77 are acted upon, so that the two heads 79 and 80 can be extended against the direction of the arrow 97. This is again done for the purpose of giving way to the blasting nozzle 93. At the end of the lifting motion of the piston rods 74 and 75, the scissors 70 and 71 reassume the starting position shown in FIGS. 1 and 2. The storage position is thus reached and the above-described operating cycle can start anew.

For the sake of completeness, it should furthermore be mentioned that a conveyor belt 98 feeds spinning cops 100 to the automatic bobbin winder 1 and that a further conveyor belt 99 is provided, on which empty tubes 101 are transported away.

The invention is not limited to the embodiment which is shown and described.

The operation of the bobbin gripping and lifting device 67 is as complicated as it is, only because room must be given to a blasting nozzle 93. The blasting nozzle is also directed toward the bobbins lying on the conveyor belt 38 in order to keep these bobbins clean. With a somewhat different construction of the lifting device, the rods 68 and 69 can be lifted equally as well as from below.

The mounting of the transfer device 51 is stationary in the illustrated embodiment. However, it would be conceivable to add this or any similar transfer device to the bobbin changer 21 as an alternative.

The number of winding stations provided at each automatic winder is not limited to ten. Several units, such as having ten winding stations each, can also be lined up. In this case, the bobbin conveyor belt 38 could be conducted past all of the units, although it would be better to provide one bobbin gripping and lifting device 67 for each unit. A different lot could then advantageously be wound in each unit. The bobbins of the lot which is not to be cleared at the moment could be intermediately stored by means of the bobbin gripper and lifting device.

We claim:

1. Automatic bobbin winder, comprising a bobbin removal location; a bobbin transfer point; a bobbin conveyor belt for storing bobbins and transporting bobbins toward said bobbin removal location, said bobbin conveyor belt having an end at said bobbin transfer point; a travelling bobbin changer disposed below said bobbin conveyor belt for transporting individual bobbins to said bobbin transfer point; a bobbin transfer device controlled by said bobbin changer for successively transferring bobbins from said bobbin changer to said bobbin conveyor belt at said bobbin transfer point; means for advancing said bobbin conveyor belt by at least one bobbin width in a given storage direction prior to each bobbin transfer; and means for initiating a priority transport run of said bobbin changer for transporting an individual bobbin to said transfer point after each bobbin transfer.

2. Automatic bobbin winder according to claim 1, wherein said priority transport run initiating means are disposed at least partly on said bobbin changer.

3. Automatic bobbin winder according to claim 1, including a machine frame being stationary relative to said bobbin changer, said priority transport run initiating means being disposed at least partly on said machine frame.

4. Automatic bobbin winder according to claim 1, wherein said bobbin transfer point is disposed in the vicinity of said bobbin removal location, said bobbin conveyor belt runs in a given forward direction toward said bobbin removal location and in a given reverse direction which is said storage direction, said bobbin transfer device including means for switching said bobbin conveyor belt to said reverse direction for a limited time prior to each bobbin transfer, and including means for switching said bobbin conveyor belt to said forward direction.

5. Automatic bobbin winder according to claim 1, including another flat bobbin conveyor disposed adjacent said first-mentioned bobbin conveyor belt downstream of said bobbin transfer point in bobbin transport direction toward said bobbin removal location, for storing bobbins and transporting bobbins to said bobbin removal location.

6. Automatic bobbin winder according to claim 5, including means for adjusting the inclination of said other flat bobbin conveyor.

7. Automatic bobbin winder according to claim 1, wherein said bobbin transfer device is part of said bobbin changer.

8. Automatic bobbin winder according to claim 1, including a machine frame, said bobbin transfer device being fixed to said machine frame at an end of said bobbin conveyor belt.

9. Automatic bobbin winder according to claim 1, wherein said bobbin transfer device includes a dish for transporting a bobbin and means for tilting said dish up and down.

10. Automatic bobbin winder according to claim 1, wherein said priority transport run initiating means includes a priority circuit favoring said bobbin transfer device over bobbin removal.

11. Automatic bobbin winder according to claim 1, including a bobbin gripping and lifting device disposed above said bobbin conveyor belt for storing bobbins in addition to said bobbin conveyor belt.

* * * * *